US009905406B2

(12) United States Patent
Brown et al.

(10) Patent No.: US 9,905,406 B2
(45) Date of Patent: Feb. 27, 2018

(54) CHARGE-STRIPPING OF MULTIPLY-CHARGED IONS

(71) Applicants: Micromass UK Limited, Wilmslow (GB); The University of British Columbia, Vancouver (CA)

(72) Inventors: Jeffery Mark Brown, Hyde (GB); Damon Robb, Vancouver (CA)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/031,015

(22) PCT Filed: Oct. 23, 2014

(86) PCT No.: PCT/GB2014/053172
§ 371 (c)(1),
(2) Date: Apr. 21, 2016

(87) PCT Pub. No.: WO2015/059488
PCT Pub. Date: Apr. 30, 2015

(65) Prior Publication Data

US 2016/0268113 A1 Sep. 15, 2016

(30) Foreign Application Priority Data

Oct. 23, 2013 (EP) ..... 13189821
Oct. 23, 2013 (GB) ..... 1318698.6

(51) Int. Cl.
*H01J 49/00* (2006.01)
*H01J 49/16* (2006.01)

(52) U.S. Cl.
CPC ..... *H01J 49/0077* (2013.01); *H01J 49/00* (2013.01); *H01J 49/165* (2013.01)

(58) Field of Classification Search
CPC .... H01J 49/00; H01J 49/0027; H01J 49/0045; H01J 49/005; H01J 49/0054;
(Continued)

(56) References Cited

U.S. PATENT DOCUMENTS 6,649,907 B2 11/2003 Ebeling et al.
6,727,497 B2 4/2004 Scalf et al.
(Continued)

OTHER PUBLICATIONS

Bagal et al., "*Gas-Phase Proton-Transfer Chemistry Coupled with TOF Mass Spectrometry and Ion Mobility-MS for the Facile Analysis of Poly(ethylene glycols) and PEGylated Polypeptide Conjugates*", Anal. Chem., vol. 80, pp. 2408-2418, 2008.
(Continued)

*Primary Examiner* — Jason McCormack

(57) ABSTRACT

A method of mass spectrometry or ion mobility spectrometry is disclosed wherein a sample is ionized by an electrified sprayer so as to produce multiply charged analyte ions of a first polarity in gas-phase. A reaction region is provided downstream of the electrified sprayer, wherein the reaction region is maintained substantially at atmospheric pressure and is maintained substantially free of electric-fields. A gas flow is provided from said electrified sprayer to said reaction region such that the gas flow carries the analyte ions from the electrified sprayer into the reaction region. Free electrons or reagent ions of a second polarity are generated in the reaction region, wherein the second polarity is opposite to said first polarity. The free electrons or reagent ions are then reacted with the analyte ions in the reaction region so as to reduce the charge state of the multiply charged analyte ions and thereby produce charge-reduced analyte ions.

23 Claims, 5 Drawing Sheets

(58) Field of Classification Search
CPC .... H01J 49/0072; H01J 49/0077; H01J 49/02; H01J 49/0445; H01J 49/045; H01J 49/08; H01J 49/10; H01J 49/14; H01J 49/165
USPC ..... 250/281, 282, 288
See application file for complete search history.

(56) References Cited

U.S. PATENT DOCUMENTS

| | | | | |
|---|---|---|---|---|
| 7,022,981 | B2 | 4/2006 | Kato | |
| 7,518,108 | B2 | 4/2009 | Frey et al. | |
| 7,679,053 | B2 | 3/2010 | Schneider et al. | |
| 8,598,514 | B2 | 12/2013 | Robb | |
| 9,123,523 | B2 | 9/2015 | Green et al. | |
| 9,129,783 | B2 | 9/2015 | Brown et al. | |
| 9,337,005 | B2 | 5/2016 | Brown et al. | |
| 2002/0142580 | A1* | 10/2002 | Yeh | H01L 21/02131 438/623 |
| 2007/0102634 | A1* | 5/2007 | Frey | H01J 49/0045 250/288 |
| 2009/0152458 | A1* | 6/2009 | Vilkov | H01J 49/0045 250/282 |
| 2011/0114835 | A1* | 5/2011 | Chen | H01J 49/0072 250/282 |
| 2011/0303839 | A1* | 12/2011 | Robb | H01J 49/0054 250/282 |
| 2012/0156792 | A1* | 6/2012 | Syka | H01J 49/0072 436/89 |

OTHER PUBLICATIONS

Bailon et al., "*PEG-Modified Biopharmaceuticals*", Expert Opinion, vol. 6, pp. 1-16, 2009.
Brown et al., "*Selective Ion-Ion Charge Reduction of Multiply Protonated Heterogeneous ESI Ions*", Proceedings of the 59th ASMS Conference; Denver, CO, 2011.
Ebeling et al., "*Corona Discharge in Charge Reduction Electrospray Mass Spectrometry*", Anal. Chem., vol. 72, No. 21, pp. 5158-5161, 2000.
Frey et al., "*Controlling Gas-Phase Reactions for Efficient Charge Reduction Electrospray Mass Spectrometry of Intact Proteins*", J. Am. Soc. Mass Spectrometry, vol. 16, pp. 1876-1887, 2005.
Frey et al., "*Ion-Ion Reactions with Fixed-Charge Modified Proteins to Produce Ions in a Single, Very High Charge State*", International Journal of Mass Spectrometry, vol. 276, pp. 136-143, 2008.
Horn et al., "*Activated Ion Electron Capture Dissociation for Mass Spectral Sequencing of Larger (42 kDa) Proteins*", Analytical Chemistry, vol. 72, No. 20, pp. 4778-4784, 2000.
Huang et al., "*Characterization of Poly(ethylene glycol) and PEGylated Products by LC/MS with Postcolumn Addition of Amines*", Anal. Chem., vol. 81, pp. 567-577, 2009.
Kemptner et al., "*GEMMA and MALDI-TOF MS of Reactive PEGs for Pharmaceutical Applications*", Journal of Pharmaceutical and Biomedical Analysis, vol. 52, pp. 432-437, 2010.
Kim et al., "*Structural Mass Spectrometry in Protein Therapeutics Discovery*", Anal. Chem., vol. 82, pp. 7083-7089, 2010.
Lennon, III, et al.,"*Ion/Molecule Reactions to Chemically Deconvolute the Electrospray Ionization Mass Spectra of Synthetic Polymers*", Anal. Chem., vol. 78, pp. 8472-8476, 2006.
McLuckey et al., "*Ion/Ion Chemistry of High-Mass Multiply Charged Ions*", Mass Spectrometry Reviews, vol. 17, pp. 369-407, 1998.
McLuckey et al., "*Ion/Ion Reactions: New Chemistry for Analytical MS*", Anal Chem., vol. 81, pp. 8669-8676, 2009.
Ogorzalek et al., "*A New Approach for the Study of Gas-Phase Ion-Ion Reactions Using Electrospray Ionization*", J. Am. Soc. Mass Spectrometry, vol. 3, pp. 695-705, 1992.
Ogorzalek et al., "*Evidence of Charge Inversion in the Reaction of Singly Charged Anions with Multiply Charged Macroions*", J. Phys. Chem., vol. 95, pp. 6412-6415, 1991.
Pitteri et al., "*Recent Developments in the Ion/Ion Chemistry of High-Mass Multiply Charged Ions*", Mass Spectrometry Reviews, vol. 24, pp. 931-958, 2005.
Robb et al., "*A New Ion Source and Procedures for Atmospheric Pressure-Electron Capture Dissociation of Peptides*", Journal of the American Society for Mass Spectrometry, vol. 22, No. 10, pp. 1699-1706, 2011.
Robb et al., "*Tandem Mass Spectrometry Using the Atmospheric Pressure Electron Capture Dissociation Ion Source*", Analytical Chemistry, vol. 86, No. 9, pp. 4439-4446, 2014.
Scalf et al., "*Charge Reduction Electrospray Mass Spectrometry*", Anal. Chem., vol. 72, pp. 52-60, 2000.
Scalf et al., "*Controlling Charge States of Large Ions*", Science, vol. 283, pp. 194-197, 1999.
Veronese et al., "*The Impact of PEGylation on Biological Therapies*", Biodrugs, vol. 22, pp. 315-329, 2008.
Xia et al., "*Evolution of Instrumentation for the Study of Gas-Phase Ion/Ion Chemistry via Mass Spectrometry*", J. Am. Soc. Mass Spectrometry, vol. 19, pp. 173-189, 2008.

* cited by examiner

CHARGE-STRIPPING OF MULTIPLY-CHARGED IONS

CROSS REFERENCE TO RELATED APPLICATION APPLICATIONS

This application is the National Stage of International Application No. PCT/GB2014/053172, filed 23 Oct. 2014 which claims priority from and the benefit of United Kingdom patent application No. 1318698.6 filed on 23 Oct. 2013 and European patent application No. 13189821.5 filed on 23 Oct. 2013. The entire contents of these applications are incorporated herein by reference.

BACKGROUND OF THE PRESENT INVENTION

PEGylation is the process whereby polyethylene glycol (PEG) is covalently bonded to a drug molecule in order to improve its pharmacokinetic, pharmacodynamic, and/or immunological characteristics. PEG is a water-soluble, non-toxic, non-immunogenic polymer approved by the FDA for internal use. In general, PEGylation increases drug solubility and reduces immunogenicity. PEGylation also increases drug stability and retention in blood, and it reduces proteolysis and renal extraction; these in turn enable reduced dosing frequency, leading to reduced costs and improved quality of life and compliance for the patient. To date, PEGylation has been used primarily to modify therapeutic proteins, though it has also been applied to peptides and antibody fragments, as well as small molecule drugs.

Structural characterization of drug molecules is essential for successful regulatory approval. Proper characterization of PEGs and PEGylated compounds requires confirmation of end group structure, mass of the repeat unit, average molecular weight, and molecular weight distribution/polydispersity. The accurate determination of these properties can be a formidable analytical challenge, in large part because of the heterogeneity/polydispersity of PEG, but also because of the high mass of the molecules in question, often ≥40 kDa. For a peptide or protein drug, it is also necessary to determine if the PEGylation reaction results in unwanted modifications to amino acid side chains. Moreover, the quality of the PEGylated product following purification must be evaluated to ensure the process is capable of yielding material of appropriate purity, and the stability of the PEGylated molecule under formulation conditions and during long term storage must be demonstrated. Similarly, the quality of the PEG starting material used in the PEGylation reaction must be assessed as it directly affects the final drug product.

Mass spectrometry (MS) is becoming an increasingly important technique for the structural characterization of polymers, including PEGs and PEGylated compounds. Matrix assisted laser desorption ionization (MALDI) combined with time-of-flight (TOF) mass analysis has been used most often for characterization of polymers by mass spectrometry. However, the structural information provided by MALDI-TOF-MS can be inadequate for larger peptides or proteins, such as those modified with larger PEGs (e.g. >20 kDa). This is because MALDI predominantly generates singly-charged ions while both the resolving power and the detection efficiency of TOF-MS instruments decrease with increasing mass to charge ratio. The singly charged ions generated with MALDI from large peptides or proteins can therefore be difficult to resolve and detect.

Electrospray ionization (ESI) may be used with TOF-MS for the analysis of polymeric compounds. ESI is different from MALDI in that it normally yields multiply charged ions distributed over a range of charge-states. Due to the multiple-charging, the ions of even very large species have mass to charge ratio values suitable for resolution and detection with TOF-MS. There is, however, a major problem with using ESI for the analysis of large polymers. That is, the peak envelope due to the distribution of molecular masses for a given charge-state generally overlaps with the peak envelope for the adjacent charge-state(s). The resulting spectra are congested and often uninterpretable, and thus incapable of yielding the desired structural information. In order to overcome this problem it is known to perform supplemental charge stripping on the electro-sprayed ions, thus lowering their charge-states and separating the peak envelopes.

Known methods of charge stripping involve generating reagent ions that are oppositely charged to the electro-sprayed ions and then reacting these reagent ions with the electro-sprayed ions in order to reduce the charge states of the electro-sprayed ions. Some of these known methods use radioactive sources to generate the reagent ions. The use of radioactive material is undesirable for obvious reasons, but it also has inherent stability issues stemming from the natural decay of radioactivity. Furthermore, in known charge stripping instruments the highly charged electrified sprayer of the ESI ion source interferes with the oppositely charged reagent ions and affects the charge reduction reactions.

It is therefore desired to provide an improved method of mass spectrometry or ion mobility spectrometry.

SUMMARY OF THE INVENTION

The present invention provides a method of mass spectrometry or ion mobility spectrometry comprising:

ionising a sample using an electrified sprayer so as to produce multiply charged analyte ions of a first polarity in gas-phase;

providing a reaction region downstream of the electrified sprayer, wherein the reaction region is maintained substantially at atmospheric pressure and is maintained substantially free of electric-fields;

providing a gas flow from said electrified sprayer to said reaction region such that the gas flow carries said analyte ions from the electrified sprayer into the reaction region;

generating free electrons or generating reagent ions of a second polarity within the reaction region, wherein said second polarity is opposite to said first polarity; and reacting the free electrons or reagent ions with the analyte ions in the reaction region so as to reduce the charge state of the multiply charged analyte ions and thereby produce charge-reduced analyte ions.

The use of a field-free reaction region at atmospheric pressure is particularly advantageous for providing stable charge stripping conditions. In particular, there are substantially no electric fields in the reaction region to disturb the free electrons or reagent ions that are being generated in the reaction region. The presence of an electric field would remove or affect these free electrons or reagent ions and would therefore affect the charge stripping reactions.

The present invention is advantageous over prior in vacuo charge-stripping methods as it does not require a means of trapping the ions within the mass spectrometer and so it can be used with spectrometers that are not expressly designed to perform gas-phase ion/ion reactions, potentially making charge-stripping a more accessible technique. The present invention is also advantageous in that a gas flow is used to carry the analyte ions from the electrified sprayer to the reaction region, rather than using an electric field, thereby enabling the reaction region to remain substantially free of electric fields. This ensures that the charge stripping reactions in the reaction region are unaffected by electric fields. These factors combine to render the method of the present invention more stable and reproducible, and also more sensitive.

According to the present invention, the free electrons or reagent ions are generated in a reaction region that is free of electric fields. The analyte ions are introduced into the reaction region so as to react with the free electrons of reagent ions. As such, the free electrons or reagent ions do not need to be conveyed into another region of the spectrometer in order for the charge stripping reactions to take place. Such conveying of the free electrons or reagent ions would require the use of electric fields, which would potentially cause free electrons or reagent ions to be lost to the system and hence would affect the charge stripping reaction rate.

US 2007/0102634 discloses a charge reduction chamber that receives analyte ions from an analyte ion source and that receives reagent ions from a reagent ion source. However, free electrons or reagent ions are not generated in a field-free reaction region that receives the analyte ions. As such, US 2007/0102634 cannot provide the advantages of the present invention. For example, the reagent ions in US 2007/0102634 are generated in a region containing electric fields and must then be conveyed into the reaction chamber, potentially causing the loss of reagent ions and affecting the charge stripping reaction rate. Also, this arrangement cannot be used to generate free electrons that react with the analyte ions. Furthermore, as electric fields are present in the region in which reagent ions are generated, the fields would have a detrimental effect on any free electrons in this region and on their use in the process of forming reagent ions.

The charge-reduced analyte ions are preferably mass analysed.

It is considered that changes in temperature shift the equilibrium conditions for the formation of reagent ions. It is thought that increasing the temperature will shift the reaction conditions in one direction so that free electrons and neutral reagent molecules are more abundant, whereas decreasing the temperature will shift the reaction conditions in the other direction so as to produce more reagent ions and hence cause a reduction in the abundance of free electrons and neutral reagent molecules. An increase in temperature may therefore be disadvantageous, as it may reduce the occurrence of charge stripping and may even create electron capture dissociation (ECD), which is not desired. The temperature of the reaction region, or the region in which the reagent ions are generated if this is not the reaction region, is therefore preferably maintained relatively low.

The method preferably comprises maintaining the temperature of the reaction region at a temperature selected from the group consisting of: ≤80° C.; ≤70° C.; ≤60° C.; ≤50° C.; ≤40° C.; ≤30° C.; ≤20° C.; ≤10° C.; or substantially at room temperature.

Preferably, substantially no fragmentation or dissociation of the analyte ions is caused by reacting the reagent ions with the analyte ions. For example, preferably substantially no electron capture dissociation (ECD) or electron transfer dissociation (ETD) occurs.

Said step of reacting the free electrons or reagent ions preferably causes the analyte ions to reduce in charge state whilst maintaining the same polarity. Preferably, the analyte ions do not reverse in polarity during the charge state reduction process.

The reaction region remains substantially free of electric fields whilst a voltage is applied to the electrified sprayer and/or whilst the sprayer is ionising the sample.

The method preferably comprises generating the free electrons and/or reagent ions within the reaction region by photoionising molecules in the reaction region.

The use of photons is preferred in the present invention because photons do not themselves generate an electric or magnetic field capable of affecting the trajectories of analyte ions, reagent ions or free electrons. The photons can also be transmitted from a remote source without the use of a strong electric or magnetic field. The use of high energy photons enables bipolar reagent ions to be formed in a spatial volume free of an electric or magnetic field. This is important because it obviates the need to provide a screen for the electric field of the reagent ion source, which may otherwise adversely impact analyte ion transmission and thus method sensitivity.

The method may comprise introducing dopant molecules into the reaction region and photoionising the dopant molecules.

The method may further comprise introducing the dopant molecules into the gas flow from the electrified sprayer to the reaction region and photoionising the dopant molecules in the reaction region.

The method may comprise varying the concentration of dopant in the reaction region with time so as to control the rate at which the free electrons and/or reagent ions are generated and hence control the rate at which the charge states of the analyte ions are reduced.

The analyte ions are preferably positive analyte ions.

The reagent ions are preferably formed by providing free photoelectrons and neutral molecules in the reaction region such that the neutral molecules are ionised by the photoelectrons to form said reagent ions.

The neutral molecules capture the electrons and become the anionic reagents for charge-stripping of protonated analytes. These neutral molecules may be: (i) trace amounts of oxygen serendipitously present in the gas stream; ii) oxygen deliberately added to the gas stream; or iii) another species such as FC-43, perfluoro-1,3-dimethylcyclohexane (PDCH), or hexafluorobenze. Reagent molecules are preferably used which are known to capture electrons and form anionic reagents that react primarily by proton transfer with positive ions, with little or no electron transfer capable of inducing Electron Transfer Dissociation (ETD).

The neutral molecules are preferably oxygen molecules which react with the photoelectrons to form superoxide anions. The oxygen is preferably serendipitous oxygen in the gas stream.

It also contemplated that neutral molecules other than oxygen may be used to form the reagent ions. Examples of such molecules are FC-43 (Perfluorotributylamine) or PDCH. The use of such molecules other than oxygen may be advantageous as the use of oxygen can cause undesirable adducts to be formed. The use of oxygen can also create superoxide anions, which are known to react to a substantial extent by electron transfer reactions and which may therefore lead to undesirable Electron Transfer Dissociation (ETD) of the analyte in addition to the proton transfer reactions, as is solely desired. If oxygen is present in the region in which the reagent ions are formed, then these molecules other than oxygen preferably have an electron affinity that is greater than that of oxygen, such that the other molecules scavenge the electrons and become charged reagent ions.

As described above, higher temperatures may shift the equilibrium condition for forming the reagent ions such that fewer reagent ions are generated and hence the extent of charge reduction may be reduced. By providing neutral molecules having a relatively high electron affinity, e.g. an electron affinity higher than that of oxygen, the neutral molecules are more likely to be ionised by electrons at higher temperature conditions. The use of such higher electron affinity neutral molecules to form the reagent ions therefore enables charge reduction to take place efficiently at relatively high temperatures, i.e. temperatures above room temperature (e.g. >20° C., >25° C., >30° C., >40° C., >50° C., >60° C., >70° C., >80° C.>90° C., or >100° C.).

It may be desirable to perform at least part of the method of the present invention at such high temperatures, e.g. to increase electrospray ionisation efficiency of the ion source and hence to increase the sensitivity of the instrument.

Preferably, the neutral molecules have a higher electron affinity than oxygen and are present in a concentration such that the neutral molecules react with the photoelectrons to form said reagent ions.

In addition to, or alternatively to using molecules of relatively high electron affinity, relatively high concentrations of neutral molecules can be used to enable the generation of sufficient reagent ions for charge reduction of the analyte ions, even at high temperatures. For example, neutral molecules may be present in the region for generating reagent ions in a concentration selected from: >1 ppm, >5 ppm, >10 ppm, >100 ppm, >500 ppm, >1000 ppm, >2000 ppm, >5000 ppm, >10 ppth, or >100 ppth.

Examples of neutral molecules that may have their concentration increased relative to ambient or atmospheric concentrations for creating reagent ions are, for example, FC-43 (Perfluorotributylamine) or oxygen. This allows the promotion of proton transfer reactions and the avoidance of ECD reactions, even at relatively high temperatures.

Less preferably, neutral molecules having a lower electron affinity than oxygen may be used to form the reagent ions. If such other molecules are used to form the reagent ions in the presence of oxygen then relatively high concentrations of such other molecules are preferably used such that the oxygen does not scavenge all of the electrons and the other molecules scavenge the electrons and become charged reagent ions. Accordingly, the neutral molecules may have a lower electron affinity than oxygen and may be present in a concentration such that the neutral molecules react with the photoelectrons to form said reagent ions. Examples of such concentrations are >1 ppm, >5 ppm, >10 ppm, >100 ppm, >500 ppm, >1000 ppm, >2000 ppm, >5000 ppm, >10 ppth, or >100 ppth.

The neutral reagent molecules preferably have a relatively low Franck-Condon Factor, e.g. of <0.1, <0.01, <0.005, or <0.001.

The method may further comprise varying the concentration of said neutral molecules within said reaction region so as to vary the concentration of reagent ions generated and hence vary the level of charge state reduction of the analyte ions.

The reaction region is preferably arranged and configured such that electric fields generated by the electrified sprayer substantially do not enter the reaction region.

A gas flow conduit may be provided between the electrified sprayer and the reaction region for carrying said gas flow from the sprayer to the reaction region, and a wire mesh may be arranged in the conduit between the electrified sprayer and the reaction region so as to substantially prevent electric fields from the electrified sprayer from entering the reaction region.

Alternatively, or additionally, a gas flow conduit may be provided between the electrified sprayer and the reaction region for carrying said gas flow from the sprayer to the reaction region, and the conduit may comprise one or more bends between the electrified sprayer and the reaction region so as to substantially prevent electric fields from the electrified sprayer from entering the reaction region.

Alternatively, or additionally, a gas flow conduit may be provided between the electrified sprayer and the reaction region for carrying said gas flow from the sprayer to the reaction region, and the diameter and length of the conduit between the electrified sprayer and the reaction region may be such that electric fields from the electrified sprayer are substantially prevented from entering the reaction region.

The reaction region may be maintained substantially free of electric-fields for a first time period and an electric field may be applied in said reaction region for a second time period.

The electric field applied during the second time period may be used to control the reaction rate at which the reagent ions are generated and/or to control the reaction rate between the reagent ions and analyte ions. The electric field may be repeatedly pulsed on and off. The magnitude and/or direction of the electric field may be varied with time for the different pulses. Additionally, or alternatively, the magnitude and/or direction of the electric field may be varied with time during the second time period or during at least one of the pulsed periods in which the electric field is applied.

Applying an electric field to the reaction region may inhibit the reactions between the analyte ions and the reagent ions, so as to reduce the level of charge stripping. Additionally, or alternatively, applying an electric field may inhibit the reaction of free electrons or charged particles with the molecules for forming the reagent ions (or with the reagent ions) and may inhibit the generation of reagent ions, and hence may reduce the level of charge stripping. The application of an electric field may also remove free electrons, which reduces the likelihood of the occurrence of ECD fragmentation. The application of the electric field can therefore be used to control the charge stripping process.

Preferably, the charge states of the analyte ions are reduced via proton transfer reactions.

Preferably, the analyte is a polyethylene glycol (PEG) or comprises at least one covalently bonded polyethylene glycol.

What the present inventors have realized is that charge-stripping of multiply charged ions via gas-phase ion/ion reactions at or near atmospheric pressure can be an effective, reliable, and accessible method for structural characterization of polymers (for example, including PEGs and PEGylated compounds) suitable for use with all kinds of electrospray mass spectrometers.

The present invention preferably uses an electrified sprayer to generate multiply charged ions from a sample solution, high energy photons to generate bipolar (i.e. both positively and negatively charged) primary reagents for gas-phase ion/ion reactions, a guide and a flow of gas for guiding multiply charged ions from the electrified sprayer to a downstream reaction region within the guide, the reaction region being at or near atmospheric pressure and substantially free of the electric field from the electrified sprayer. The bipolar primary reagents initiate a series of reactions within the reaction region that ultimately result in charge-stripping from the multiply charged ions generated by the electrified sprayer. Ions exiting the reaction region may then be passed through the inlet of the mass spectrometer's atmosphere-vacuum interface for subsequent mass analysis and detection.

The present invention may be applied to sample solutions comprised of a solvent and one or more analytes. The sample solution may optionally by subjected to a liquid chromatography step to separate each analyte from other substances in the solution before introduction into the electrified sprayer.

The use of an electrified sprayer is important for achieving high sensitivity with the method, as electrified sprayers are one of the best means of generating multiply charged ions from a sample solution at or near atmospheric pressure. The electrified sprayer may be held at either a positive or negative potential relative to its surroundings, so that multiply charged analyte ions of either polarity may be generated. The electrified sprayer is preferably a nanospray emitter, but other types of sprayers may also be used, including electrospray, microspray, and electrosonic-spray sources. The electrified sprayer may also be an "ionspray" source, using pneumatic assistance, whereby a flow of gas aids in nebulization and vaporization of the liquid sample. Heat may also be applied to the spray, to assist in vaporization of the liquid sample, through any number of known means, including the use of a pre-heated nebulizer or auxiliary gas.

High energy photons are preferably used to generate the bipolar reagent ions. This avoids the use of either radioactive material or a corona discharge to generate such ions. The use of radioactive material for charge-stripping methods is problematic because it may require special licensing and handling procedures, depending upon the setting, and also because the natural decay of radioactivity impacts the stability of the method. The use of a corona discharge can be problematic because of performance issues stemming from their tendency to generate reactive radical species and/or adduct-forming nitrate anions that lower sensitivity and complicate the spectra obtained. Furthermore, the use of photons is preferred in the present invention because photons do not themselves generate an electric or magnetic field capable of affecting the trajectories of analyte ions, reagent ions or free electrons. The photons can also be transmitted from a remote source without the use of a strong electric or magnetic field. The use of high energy photons enables the bipolar reagent ions to be formed in a spatial volume free of an electric or magnetic field from the reagent ion source. This is important because it obviates the need to provide a screen for the electric field of the reagent ion source, which may otherwise adversely impact analyte ion transmission and thus method sensitivity.

The use of a guide and a flow of gas for guiding the multiply charged ions to a downstream reaction region within the guide is important for obtaining high sensitivity with the method. The guide and the flow of gas serve to deliver multiply charged ions from the electrified sprayer to the downstream reaction region with a minimum of ion losses. The guide may be a tube, channel, or conduit, or other similar means of confining and directing a flow of gas. The guide may have a single section or it may have several connected sections. Preferably, at least one section of the guide may be heated, to promote vaporization of charged droplets from the sprayer and also possibly to increase the efficiency of the charge-stripping reactions, which may be temperature dependent. Preferably, the gas used to transport the multiply charged analyte ions within the guide is high-purity nitrogen, although other gases such as air, or nitrogen mixed with oxygen, may be used.

The bipolar reagent ions are formed by photoionization of an ionizable gas-phase species, resulting in the production of an oppositely charged pair of primary reagents, i.e. a radical cation and a photoelectron. The ionizable gas-phase species may be added to the source intentionally to promote photoionization in which case it is termed a "dopant." Alternatively, the photoionizable species may be a volatile component of the solvent carrying the sample. Preferably, the bipolar reagent ions are formed by photoionization of a suitable dopant, such as toluene or acetone, directly within the reaction region. By controlling the concentration of dopant in the reaction region, the quantity of bipolar reagents generated can be controlled, providing a convenient means of controlling the rate of the charge-stripping reactions, and thus the final charge state distribution of the analyte ions. Alternatively, the quantity of bipolar reagents generated can be controlled by controlling the intensity (flux) of the ionizing photons. However, it is generally simpler to vary the concentration of dopant than it is to vary the photon intensity, and so varying the concentration of the dopant is the preferred means of controlling the quantity of reagent ions produced.

The photon source for bipolar primary reagent generation is preferably a gas discharge lamp, such as a Krypton discharge lamp, which preferably has a continuous output. Krypton discharge lamps produce high energy photons capable of generating photoelectrons from many substances, and they are inexpensive and compact. Alternatively, the photon source may be a laser or some other means. The lamp or laser may be pulsed, though continuous output is often preferred.

The multiply charged analyte ions are mixed with the bipolar reagent ions in a reaction region to cause gas-phase ion/ion reactions and charge-stripping of the multiply charged analyte ions. The bipolar reagent ions are formed directly in the reaction region, so that no additional mixing step is required and transport losses are eliminated.

The primary reagents may react directly with the multiply charged analyte ions to induce charge stripping, or the primary reagents may first react with other gas-phase species to form intermediate reaction products that become the charge-stripping reagents. For example, a photoelectron may be captured by a neutral oxygen molecule to form a superoxide anion ($O_2^-$) which may serve as a reagent for stripping charge from a positively charged analyte via proton transfer from the analyte. Alternatively, a positively charged reaction intermediate resulting from the primary radical cation (such as a protonated solvent ion) may reduce the charge of a negatively charged analyte via proton transfer to the analyte. Further, it may be desirable to deliberately add neutral reagents to the gas to react with the electrons and/or oppositely charged reagent ions normally present, so as to generate particular reagent ions for subsequent charge-stripping reactions with the multiply charged analyte(s).

It is important that the reaction region of the guide be substantially free of the electric field from the electrified sprayer. This is because the electric field from the sprayer is capable of attracting oppositely charged reagents to the sprayer, adversely affecting the production of multiply charged analyte ions and also eliminating the charge-stripping reagents. Shielding the reaction region from the electric field of the sprayer may be achieved by several means, including making the guide of sufficient length that the sprayer is sufficiently remote from the reaction region that the field does not substantially reach the reaction region. Alternatively, a wire screen at the potential of the reaction region may be included between the sprayer and the reaction region, or a curve may be included in the guide between the sprayer and the reaction region, or any of the above solutions may be used in combination. It is generally preferable to minimize the separation of the electrified sprayer from the reaction region in order to minimize transport losses and then to screen the reaction region from the electric field of the sprayer with a high-transmission wire mesh at the potential of the reaction region.

For the generation of positively charged analyte ions, it is generally preferred that the electric potential of the electrified sprayer should be more positive than that of the guide section enclosing the reaction region, which should in turn be more positive than that of the inlet of the atmosphere-vacuum interface of the mass spectrometer. The opposite is true for the generation of negatively charged analyte ions. This is to maximize the transmission of multiply charged analyte ions from the electrified sprayer to the reaction region of the guide, and then into the mass analyzer of the mass spectrometer.

The present invention also provides a mass spectrometer or ion mobility spectrometer configured to perform any one of the methods described herein.

Therefore, the present invention provides a mass spectrometer or ion mobility spectrometer comprising:

an electrified sprayer configured to ionise a sample so as to produce multiply charged analyte ions of a first polarity in gas-phase;

a reaction region arranged downstream of the electrified sprayer, wherein the reaction region is configured to be maintained substantially at atmospheric pressure and maintained substantially free of electric fields;

means for providing a gas flow from said electrified sprayer to said reaction region such that, in use, the gas flow carries said analyte ions from the electrified sprayer into the reaction region; and means for generating free electrons or for generating reagent ions of a second polarity within the reaction region, wherein said second polarity is opposite to said first polarity, such that the free electrons or reagent ions react with the analyte ions in the reaction region to reduce the charge state of the multiply charged analyte ions and thereby produce charge-reduced analyte ions.

The spectrometer may comprise:

(a) one or more ion guides; and/or (b) one or more ion mobility separation devices and/or one or more Field Asymmetric Ion Mobility Spectrometer devices; and/or (c) one or more ion traps or one or more ion trapping regions; and/or (d) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (e) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (f) one or more energy analysers or electrostatic energy analysers; and/or (g) one or more ion detectors; and/or (h) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (i) a device or ion gate for pulsing ions; and/or (j) a device for converting a substantially continuous ion beam into a pulsed ion beam.

The spectrometer may comprise either:

(i) a C-trap and an Orbitrap® mass analyser comprising an outer barrel-like electrode and a coaxial inner spindle-like electrode, wherein in a first mode of operation ions are transmitted to the C-trap and are then injected into the Orbitrap® mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the Orbitrap® mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may further comprise a device arranged and adapted to supply an AC or RF voltage to the electrodes.

The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

Charge-stripping of electro-sprayed ions is particularly useful in the mass spectrometric analysis of heterogeneous mixtures such as polyethylene glycols (PEGs) and "PEGylated" protein therapeutics. Charge-stripping prior to mass analysis is important for these mixtures because their components are generally highly charged upon ionization by electro-spray, yielding congested and often uninterpretable mass spectra with overlapping molecular mass and charge-state distributions. Structural characterization of PEGs and PEGylated compounds via mass spectrometry may be impossible under these conditions. With charge-stripping, however, a portion of the charge is removed from the electro-sprayed ions prior to mass analysis, shifting the peak envelopes to higher mass to charge ratio regions where peak overlap is reduced and enabling the compounds to be analyzed successfully.

This invention provides an improved method and apparatus for charge-stripping of multiply charged ions in an atmospheric pressure ion source. The preferred embodiment of the present invention uses an electrified sprayer to generate multiply charged ions from a sample solution, high energy photons to generate bipolar (i.e., both positively and negatively charged) primary reagents for gas-phase ion/ion reactions, and a guide and a flow of gas for guiding multiply charged ions from the electrified sprayer to a downstream reaction region within the guide, the reaction region being at or near atmospheric pressure and substantially free of the electric field from the electrified sprayer. The bipolar primary reagents initiate a series of reactions within the reaction region that ultimately result in charge-stripping from the multiply charged ions generated by the electrified sprayer. Ions exiting the reaction region are then passed through the inlet of the mass spectrometer's atmosphere-vacuum interface for subsequent mass analysis and detection.

BRIEF DESCRIPTION OF THE DRAWINGS

The present invention will be further understood from the following description with reference to the accompanying drawing of a representative charge-stripping ion source according to the invention, in which all views are schematic and may not be to scale.

Figure 1:
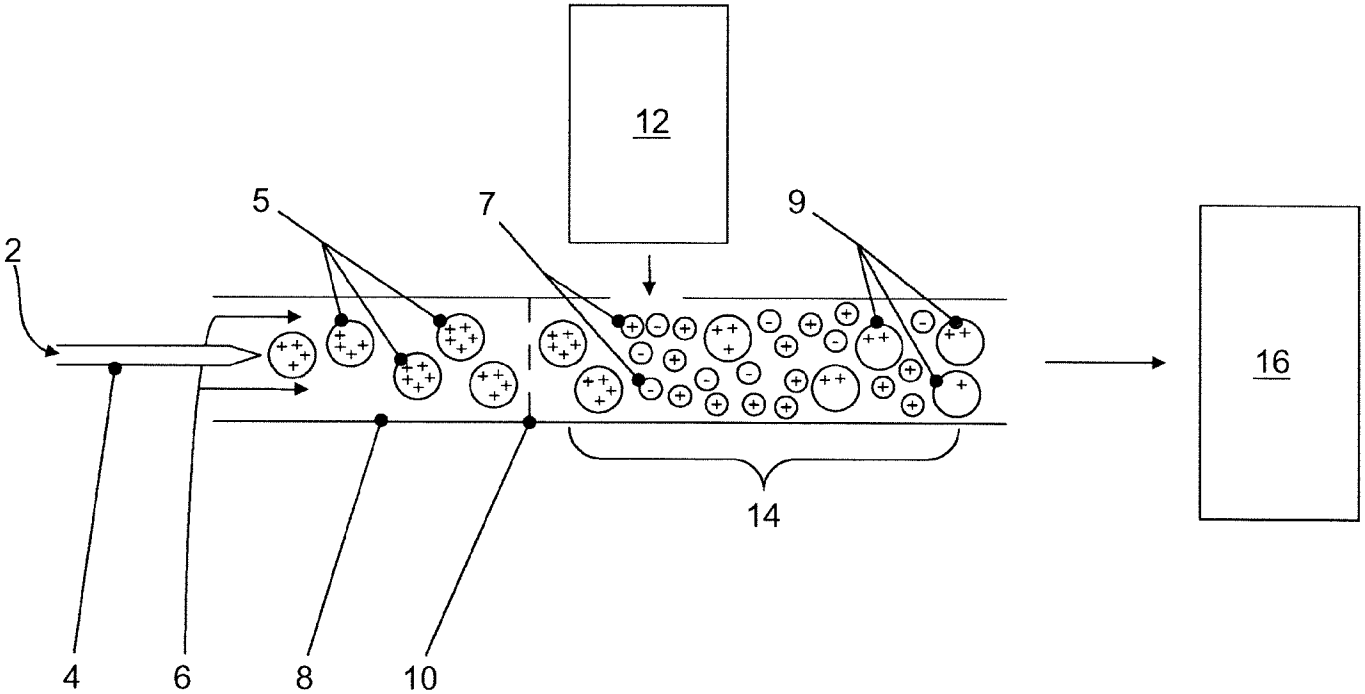
FIG. 1 illustrates a schematic diagram of an embodiment of the present invention.

In the drawings, preferred embodiments of the charge-stripping ion source according to the invention are illustrated by way of example. It is to be understood that the description and drawings are only for the purpose of illustration and as an aid to understanding, and are not intended to be a constraint on the limits of the invention.

DETAILED DESCRIPTION OF PREFERRED EMBODIMENTS

Referring to FIG. 1, there is illustrated a schematic diagram for an in-source atmospheric pressure charge-stripping method for mass spectrometric analysis of samples in accordance with an embodiment of the present invention. A liquid sample (2) is introduced into an electrified sprayer (4) by which gas-phase analyte ions having multiple charges (5) are produced. The gas-phase analyte ions (5) of the present example are positively charged, though the invention may alternately be used to generate negatively charged gas-phase analyte ions. The multiply charged analyte ions (5) are swept from the electrified sprayer (4) by a flow of gas (6) through a guide (8) for guiding the multiply charged analyte ions (5) towards a downstream reaction region (14) within the guide (8). A wire screen (10) is situated within the guide (8) between the electrified sprayer (4) and the reaction region (14) to shield the reaction region (14) from the electric field of the electrified sprayer (4). Bipolar primary reagent ion species (7) are generated using a bipolar primary ion reagent production means (12) comprised of a high energy photon source capable of photoionizing an ionizable species in the source, preferably a dopant mixed in the gas flow (6). The bipolar primary reagent ion production means (12) is situated downstream of the electrified sprayer (4) such that the bipolar reagent ion species (7) that are produced therefrom intersect the multiply charged ions (5) in the reaction region (14). The bipolar primary reagent ion species (7) are produced within the reaction region (14). The multiply charged ions (5) are mixed with the bipolar reagent ion species (7) in the reaction region (14) at or near atmospheric pressure. This mixing of these ionic species results in neutralization (charge-stripping) of a portion of the charge of the multiply charged ions, via gas-phase ion/ion reactions, to lower the charge state of the multiply charged ions (9) which are then passed into a mass analyzer (16) of a mass spectrometer. It is expressly understood that the arrangement of the elements of the method as depicted in FIG. 1 are for illustration only and should not be construed to limit the geometrical arrangement of the various elements of the invention. Various geometrical and spatial arrangements of the elements and the means of connecting the elements are possible.

Figure 2:
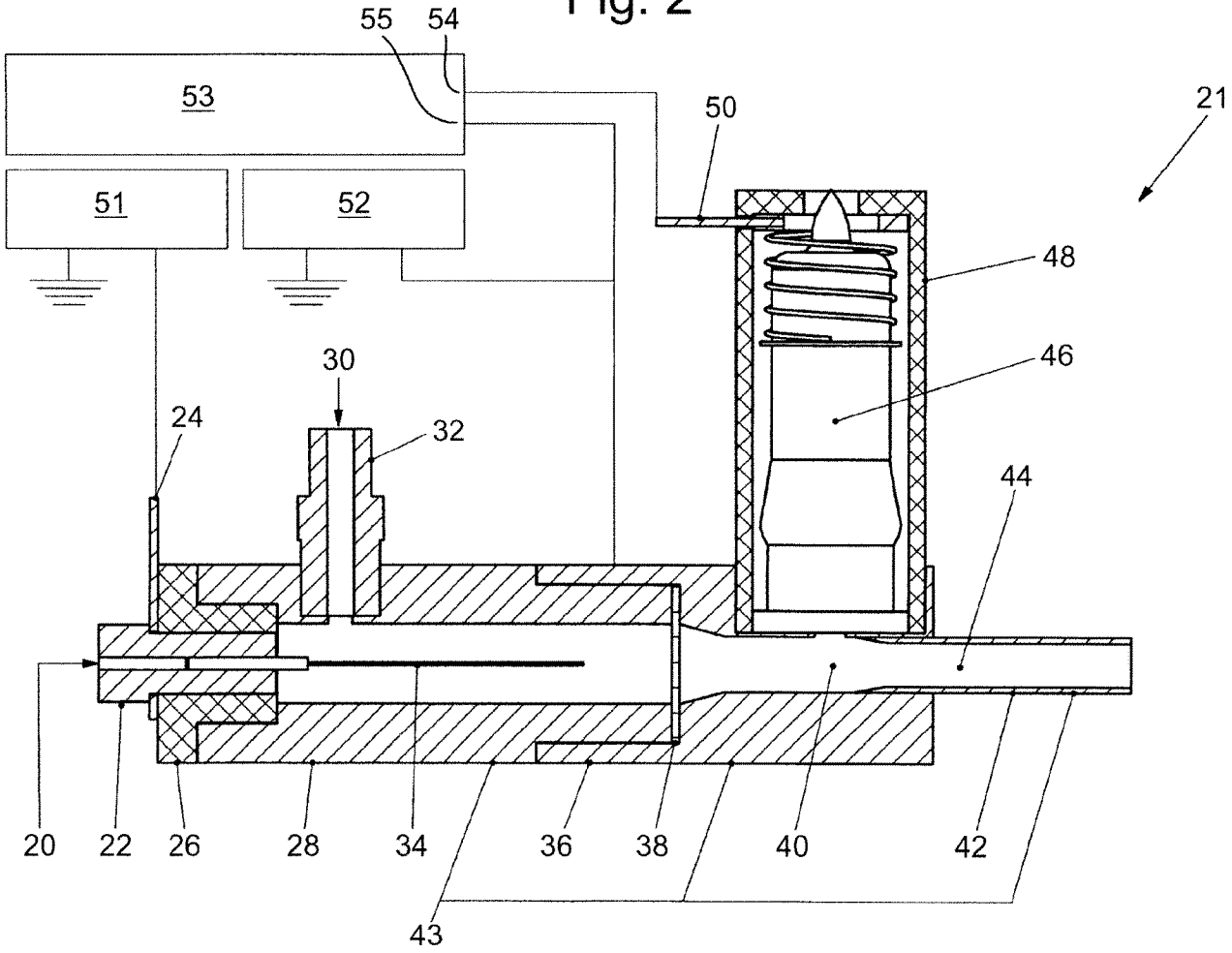
FIG. 2 illustrates an embodiment of the apparatus of the present invention including a nanospray emitter.

Referring to FIG. 2, an apparatus (21) in accordance with a preferred embodiment of the present invention is shown. The major features of the apparatus (21) comprise a nanospray emitter (34) for producing multiply charged analyte ions, a gas-discharge lamp (46) for producing bipolar primary reagents (radical cations and photoelectrons), a flow of gas (30) and a hollow guide (43) comprised of three connected sections each having a central channel, namely, a first guide section (28), a second guide section (36), and a third guide section (42), the hollow guide (43) for guiding the multiply charged analyte ions, and a high-transmission wire mesh (38) located between the first guide section (28) and the second guide section (36), said wire mesh (38) designed and configured to screen a reaction region (44) of the guide (43) from the electric field of the nanospray emitter (34). The reaction region (44) is located downstream of the nanospray emitter (34) within the central channel of the hollow guide (43).

Now describing the apparatus (21) of FIG. 2 in detail, a liquid sample (20) is introduced into a stainless-steel union (22) for coupling the liquid sample (20) to the nanospray emitter (34). The union (22) allows for standard 1/16" outer diameter tubes to be joined on each side, with minimal dead-volume therebetween. The liquid sample (20) is delivered into the union (22) from the upstream side thereof, while the fused silica nanospray emitter (34) is fixed to the downstream side of the union (22). The union (22) is mounted and fastened within an electrically-insulating polyimide plug (26) which plug (26) is removably inserted into the central channel of the first section (28) of the stainless-steel guide (43) from the upstream end. The plug (26) is designed and configured to be removable from the first guide section (28) so as to provide easy access to the nanospray emitter (34) in case the nanospray emitter (34) must be replaced. The union (22), the plug (26) and the first guide section (28) are all mounted such that a substantially hermetic seal is maintained between the central channel of the first guide section (28) and the outside atmosphere, to prevent air from entering the guide (43) and to prevent the contents of the guide (43) from escaping. A stainless-steel electrode (24) connected to a first high voltage power supply (51) is held in electrical connection with the union (22) before the plug (26); the electrode (24) is provided simply as a means of connecting the first power supply (51) to the union (22). The liquid sample (20), the union (22) and the electrode (24) are all in electrical contact, so that the liquid sample (20) is electrified during transit through the union (22), which ultimately leads to the formation of multiply charged analyte ions at the exit of the nanospray emitter (34).

A flow of gas (30), introduced and directed substantially perpendicularly to the hollow guide (43) is introduced into the first guide section (28) through a stainless-steel union (32) coupling the first guide section (28) and the source for the flow of gas (30). One end of the union (32) accepts a standard 1/8" outer diameter tube used to deliver the flow of gas (30), while the other end is threaded for mating with a matching tapped hole in the first guide section (28). Multiply charged ions exiting the downstream end of the nanospray emitter (34) are guided through the first guide section (28) by the flow of gas (30). The gas (30) preferably consists of substantially pure nitrogen doped with a volatile photoionizable species such as acetone or toluene. As the gas (30) enters the guide (43), the gas (30) envelopes the nanospray emitter (34) within the first guide section (28) so that ions exiting the emitter are swept through the guide (43) by the gas (30). The inner diameter of the first guide section (28) is relatively large (10 mm in this embodiment) so that the velocity of the gas (30) at a given flow rate (typically around 10 l $min^{-1}$) around the nanospray emitter (34) is relatively low, which helps prevent the gas flow (30) from disrupting the electrospray plume at the tip of the emitter (34).

A high-transmission wire mesh (38) is situated downstream of the nanospray emitter (34), between the first (28) and second (36) guide sections and in electrical connection therewith. The second guide section (36) is connected to a second high voltage supply (52). The first guide section (28), the wire mesh (38) and the second guide section (36) are all in electrical contact and are all held at the same electrical potential. The absolute value of the potential of the first high voltage power supply is greater than (and of the same polarity as) that of the second high voltage supply (52), to provide a strong electric field between the tip of the nanospray emitter (34) and the first section of the guide (28), as well as the wire mesh (38), and thereby to promote electrospray ionization of the liquid sample (20) as well as to assist in the delivery of multiply charged ions downstream. Openings in the wire mesh (38) permit multiply charged ions to be transmitted by the gas flow (30) into the downstream second (36) and third (42) guide sections. Because the wire mesh (38) and the surfaces of the neighbouring downstream guide sections (36, 42) are all at the same electrical potential, the reaction region (44) of the guide (43) is substantially field-free, effectively shielded from the electric field of the nanospray emitter (34).

The second guide section (36) has a tapered entrance to reduce the internal diameter of its central channel (down to 7 mm in this embodiment) and thereby to increase the velocity of the gas flow (30) so that the residence time of multiply charged ions within the guide is decreased proportionally. It is desirable to minimize the residence time of multiply charged ions within the guide so that losses of ions due to diffusion to the walls of the guide are minimized (ions encountering the walls of the guide will be neutralized, preventing their detection by the mass spectrometer).

A krypton discharge lamp (46), within an electrically-insulating cylindrical lamp holder made of polyimide (48), is mounted in the side of the second guide section (36) such that high energy photons generated in the lamp (46) are transmitted into the central channel of the second guide section (36) through an aperture in the wall of the second guide section (36). The lamp (46) receives power from a lamp power supply (53) electrically connected thereto. The negative high voltage outlet (54) of the lamp power supply (53) is in contact with an electrode (50) within the lamp holder (48) which is in electrical contact with the cathode of the lamp (46) via a metal spring. The high voltage return (55) of the lamp power supply (53) is in electrical communication with the second guide section (36) which is in communication with the anode of the face of the lamp (46) and the high voltage return (55) is also in electrical communication with the second high voltage power supply (52), effectively floating the guide (43), the lamp (46) and the lamp power supply (53) at the voltage of the second power supply (52).

High energy photons from the lamp (46) intersect the gas flow (30) bearing the multiply charged analyte ions in a bipolar primary reagent generation region (40) within the central channel of the second guide section (36) where radical cations and photoelectrons are generated via photoionization of an ionizable species doped into the gas flow (30).

Further, in the bipolar primary reagent generation region (40) any multiply charged analyte ions in the gas flow (30) commence reacting with the generated oppositely charged reagents resulting in charge-stripping from at least a portion of the analyte ions having multiple positive charges. The reaction mixture is guided from the bipolar primary reagent generation region (40) by the flow of gas (30) into the third and final guide section (42). The third guide section (42) also has a tapered entrance to reduce the diameter of its central channel and thereby increase the gas velocity and minimize ion losses due to diffusion. The inner volume of the third guide section (42) comprises the remainder of the reaction region (44) in which charge-stripping occurs. Upon exiting the guide (43) under the influence of the gas flow (30), ions are transferred into the mass analyzer of the mass spectrometer for mass analysis. This transfer is improved by maintaining the potential of the guide (43), as set by the second high voltage power supply (52), at a value suitable for directing the analyte ions towards the inlet of the atmosphere-vacuum interface of the downstream mass analyzer.

Figure 3:
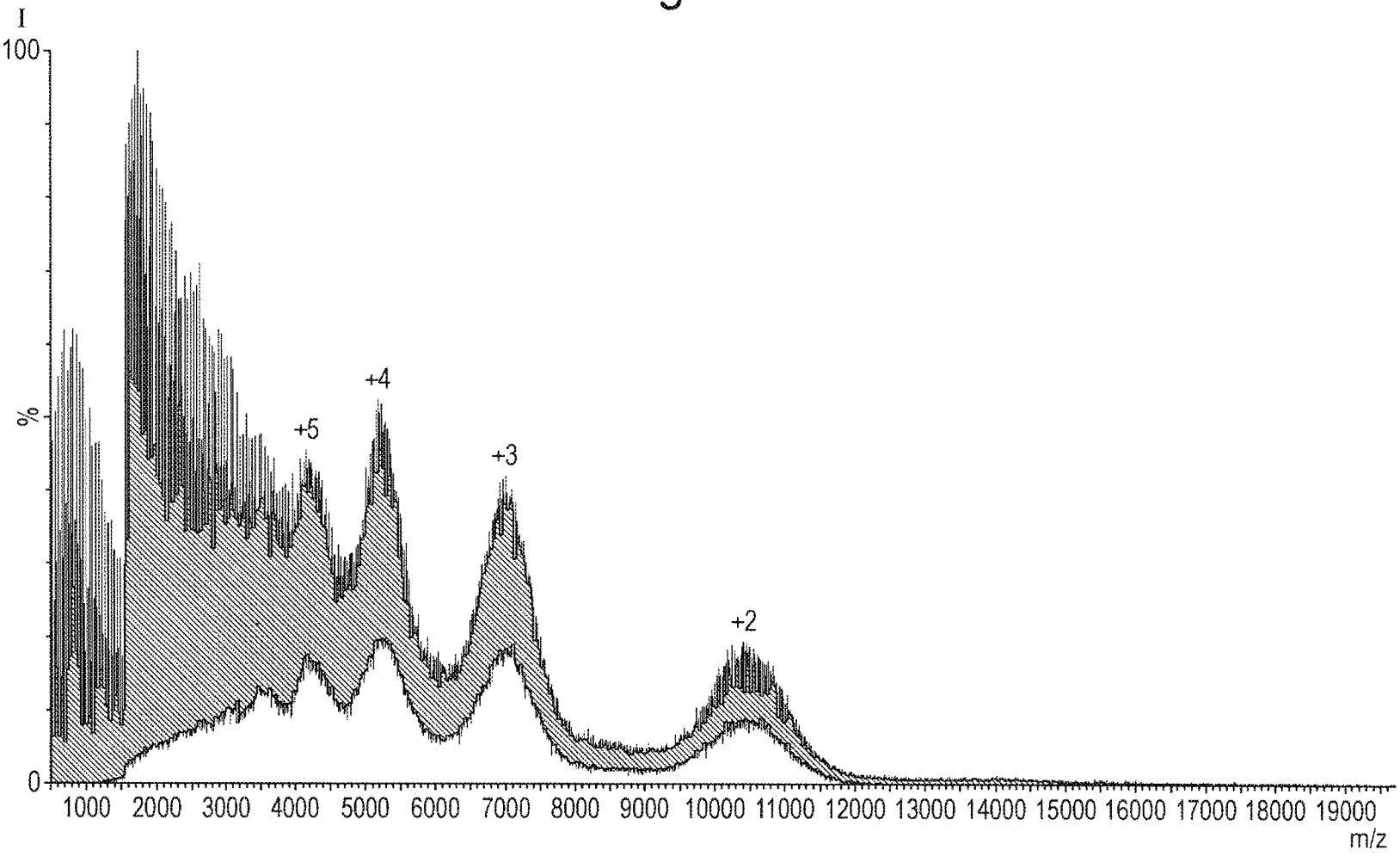
FIG. 3 illustrates an exemplary mass spectral trace of PEG 20K after charge-stripping, obtained using an embodiment of the present invention.

Referring to FIG. 3, there is illustrated an exemplary mass spectrum of PEG 20K, a high-MW polymer representative of the type of sample to be analyzed by the present invention, obtained using an embodiment of the present invention. For this example, the charge-stripping ion source device was substantially the same as that depicted in FIG. 2, and the mass spectrometer used was a Synapt-G2S™ Q-TOF from Waters-Micromass (Manchester, UK). The spectrum of FIG. 3 clearly shows the peak envelopes due to the polymeric distribution of molecular masses for charge-states +4, +3, and +2, with the peak envelopes from the lower charge-states being well-resolved from those of the higher charge states, and thus the spectrum is capable of yielding the desired structural information for the sample. Significantly, without charge-stripping, the same sample yielded only ions of higher charge-states, with overlapping molecular mass peak envelopes, and so individual mass peaks could not be resolved and structural information for the sample was unattainable.

Figure 4A:
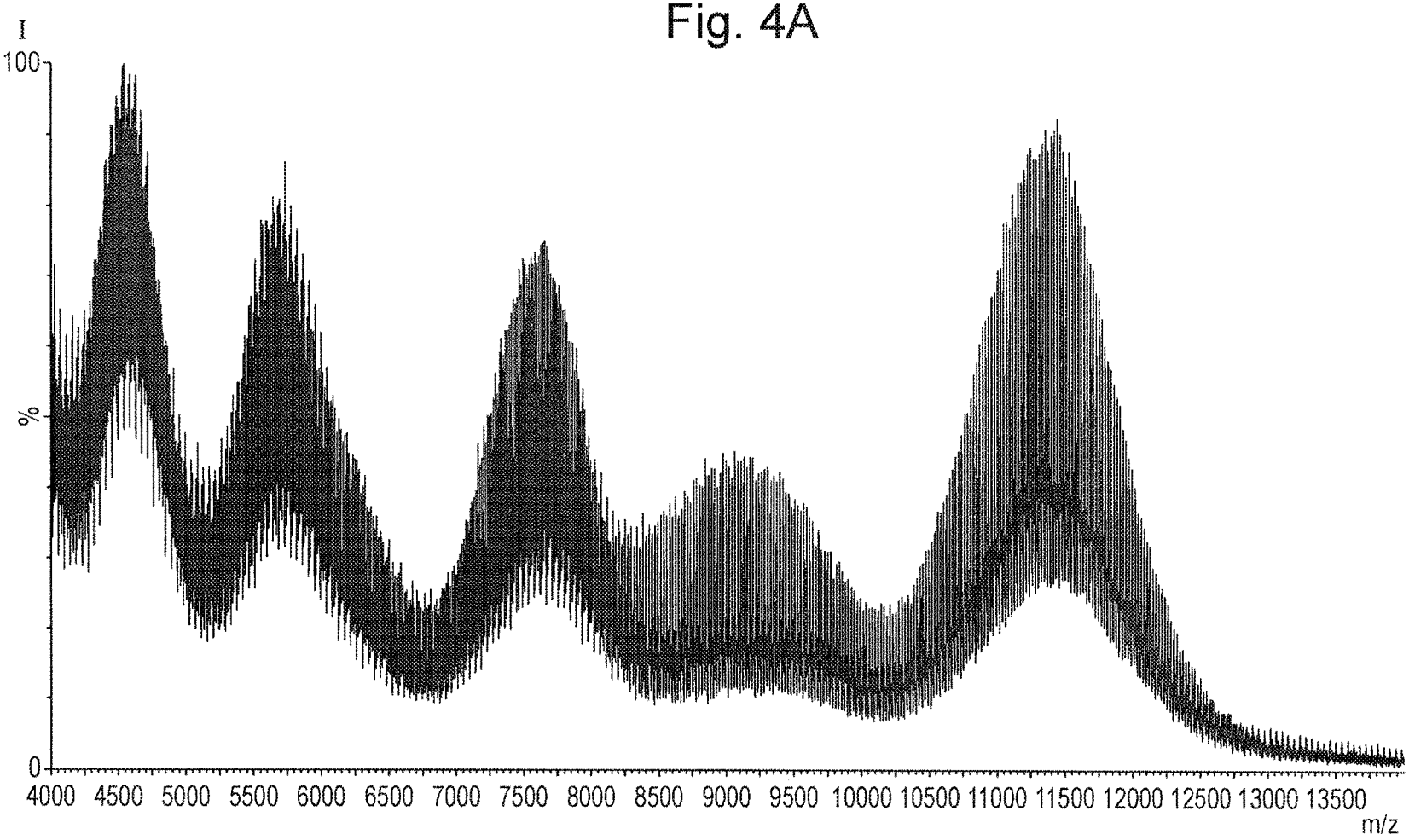
FIGS. 4A and 4B show mass spectral data obtained using FC-43 as a charge stripping agent.
Figure 4B:
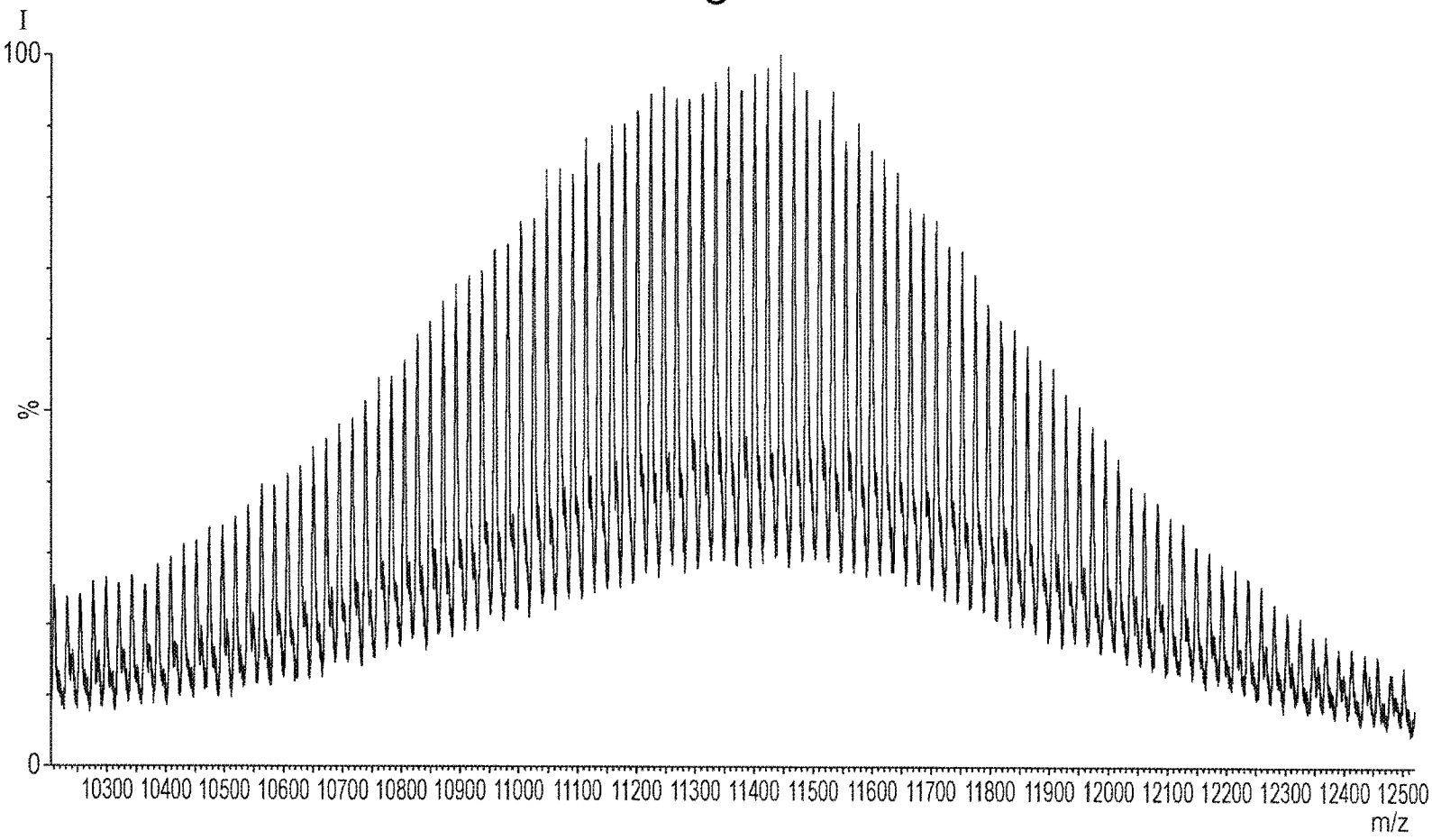

FIGS. 4A and 4B show mass spectral data obtained using FC-43 as a charge stripping agent. FIG. 4B shows an expanded view of a portion of the spectrum shown in FIG. 4A. The FC-43 acts as a reagent to suppress ECD/ETD.

Other variations and modifications of the invention are possible and aspects of some of these have been described above. For example, the liquid sample stream may be composed of a solution of sample in a solvent or solvent mixture, and the solvent or other additives may be used to provide a volatile component that is photoionizable to produce the gas phase bipolar primary reagents. In addition, a variety of electrified spray means may be employed in the practice of the invention. The electrified sprayer described above is but one of a number of different possible electrified spray means that can be employed in accordance with the invention. Electrified spray means include nanospray, electrospray, microspray, electrosonic spray and ionspray. All such modifications or variations and others that will occur to those skilled in the design of such systems are considered to be within the scope of the invention, as defined by the appended claims.

The invention claimed is:

1. A method of mass spectrometry or ion mobility spectrometry comprising:

ionising a sample using an electrified sprayer so as to produce multiply charged analyte ions of a first polarity in gas-phase;

providing a reaction region downstream of the electrified sprayer, wherein the reaction region is maintained substantially at atmospheric pressure, is maintained at a temperature of ≤80° C., and is maintained substantially free of electric-fields;

providing a gas flow from said electrified sprayer to said reaction region such that the gas flow carries said analyte ions from the electrified sprayer into the reaction region;

generating free electrons or generating reagent ions of a second polarity within the reaction region, wherein said second polarity is opposite to said first polarity;

reacting the free electrons or reagent ions with the analyte ions in the reaction region so as to reduce the charge state of the multiply charged analyte ions and thereby produce charge-reduced analyte ions; and analysing the charge-reduced analyte ions.

2. The method of claim 1, comprising maintaining the temperature of the reaction region at a temperature selected from the group consisting of: ≤70° C.; ≤60° C.; ≤50° C.; ≤40° C.; ≤30° C.; ≤20° C.; ≤10° C.; or substantially at room temperature.

3. The method of claim 1, wherein substantially no fragmentation or dissociation of the analyte ions is caused by reacting the reagent ions with the analyte ions.

4. The method of claim 1, wherein said step of reacting the free electrons or reagent ions causes the analyte ions to reduce in charge state whilst maintaining the same polarity.

5. The method of claim 1, wherein the reaction region remains substantially free of electric fields whilst a voltage is applied to the electrified sprayer and/or whilst the sprayer is ionising the sample.

6. The method of claim 1, comprising generating the free electrons and/or reagent ions within the reaction region by photoionising molecules in the reaction region.

7. The method of claim 6, comprising introducing dopant molecules into the reaction region and photoionising the dopant molecules.

8. The method of claim 7, comprising introducing the dopant molecules into the gas flow from the electrified sprayer to the reaction region and photoionising the dopant molecules in the reaction region.

9. The method of claim 7, comprising varying the concentration of dopant in the reaction region with time so as to control the rate at which the free electrons and/or reagent ions are generated and hence control the rate at which the charge states of the analyte ions are reduced.

10. The method of claim 1, wherein the reagent ions are formed by providing free photoelectrons and neutral molecules in the reaction region such that the neutral molecules are ionised by the photoelectrons to form said reagent ions.

11. The method of claim 10, wherein the neutral molecules are oxygen molecules which react with the photoelectrons to form superoxide anions.

12. The method of claim 10, wherein the neutral molecules have a higher electron affinity than oxygen and are present in a concentration such that the neutral molecules react with the photoelectrons to form said reagent ions.

13. The method of claim 10, further comprising varying the concentration of said neutral molecules within said reaction region so as to vary the concentration of reagent ions generated and hence vary the level of charge state reduction of the analyte ions.

14. The method of claim 1, wherein the reaction region is arranged and configured such that electric fields generated by the electrified sprayer substantially do not enter the reaction region.

15. The method of claim 14, wherein a gas flow conduit is provided between the electrified sprayer and the reaction region for carrying said gas flow from the sprayer to the reaction region, and wherein a wire mesh is arranged in the conduit between the electrified sprayer and the reaction region so as to substantially prevent electric fields from the electrified sprayer from entering the reaction region.

16. The method of claim 14, wherein a gas flow conduit is provided between the electrified sprayer and the reaction region for carrying said gas flow from the sprayer to the reaction region, and wherein the conduit comprises one or more bends between the electrified sprayer and the reaction region so as to substantially prevent electric fields from the electrified sprayer from entering the reaction region.

17. The method of claim 14, wherein a gas flow conduit is provided between the electrified sprayer and the reaction region for carrying said gas flow from the sprayer to the reaction region, and wherein the diameter and length of the conduit between the electrified sprayer and the reaction region are such that electric fields from the electrified sprayer are substantially prevented from entering the reaction region.

18. The method of claim 1, wherein the reaction region is maintained substantially free of electric-fields for a first time period and an electric field is applied in said reaction region for a second time period.

19. The method of claim 18, wherein the electric field applied during the second time period is used to control the reaction rate at which the reagent ions are generated and/or to control the reaction rate between analyte ions and either the free electrons or reagent ions.

20. The method of claim 1, wherein the charge states of the analyte ions are reduced via proton transfer reactions.

21. The method of claim 1, wherein the analyte is a polyethylene glycol (PEG) or comprises at least one covalently bonded polyethylene glycol.

22. A mass spectrometer or ion mobility spectrometer comprising:

an electrified sprayer configured to ionise a sample so as to produce multiply charged analyte ions of a first polarity in gas-phase;

a reaction region arranged downstream of the electrified sprayer, wherein the reaction region is configured to be maintained substantially at atmospheric pressure, maintained at a temperature of ≤80° C., and maintained substantially free of electric fields;

means for providing a gas flow from said electrified sprayer to said reaction region such that, in use, the gas flow carries said analyte ions from the electrified sprayer into the reaction region;

means for generating free electrons or for generating reagent ions of a second polarity within the reaction region, wherein said second polarity is opposite to said first polarity, such that the free electrons or reagent ions react with the analyte ions in the reaction region to reduce the charge state of the multiply charged analyte ions and thereby produce charge-reduced analyte ions; and means for analysing the charge-reduced analyte ions.

23. The method of claim 1, wherein analysing the charge-reduced analyte ions comprises determining structural information for the charge-reduced analyte ions.

* * * * *